US006860783B1

(12) United States Patent
Kucha et al.

(10) Patent No.: US 6,860,783 B1
(45) Date of Patent: Mar. 1, 2005

(54) DISC TOY

(76) Inventors: Edward T. Kucha, 1112 Snyder Ave., Scranton, PA (US) 18504; Lori Romanowski, 1112 Snyder Ave., Scranton, PA (US) 18504

( * ) Notice: Subject to any disclaimer, the term of this patent is extended or adjusted under 35 U.S.C. 154(b) by 0 days.

(21) Appl. No.: 10/764,308

(22) Filed: Jan. 26, 2004

(51) Int. Cl.[7] ..... A63H 27/00
(52) U.S. Cl. ..... 446/46; 446/47
(58) Field of Search ..... 446/46, 47, 48; D21/443

(56) References Cited

U.S. PATENT DOCUMENTS

| | | | | | |
|---|---|---|---|---|---|
| 3,531,892 | A | * | 10/1970 | Pearce | 446/242 |
| 3,720,018 | A | * | 3/1973 | Peterson et al. | 446/47 |
| 3,786,246 | A | * | 1/1974 | Johnson et al. | 446/47 |
| 3,798,834 | A | * | 3/1974 | Samuel | 446/47 |
| 3,812,614 | A | * | 5/1974 | Harrington | 446/47 |
| 4,086,723 | A | | 5/1978 | Strawick | |
| 4,132,031 | A | * | 1/1979 | Psyras | 446/47 |
| 4,254,575 | A | * | 3/1981 | Gould | 446/46 |
| D260,786 | S | * | 9/1981 | Chaklos | D21/443 |
| 4,431,196 | A | * | 2/1984 | Kutnyak | 473/588 |
| 5,083,799 | A | * | 1/1992 | Thill | 473/588 |
| 5,290,184 | A | * | 3/1994 | Balogh et al. | 446/47 |
| 5,319,531 | A | | 6/1994 | Kutnyak | |
| 5,536,195 | A | | 7/1996 | Stamos | |
| 5,611,720 | A | | 3/1997 | Vandermaas | |
| 5,674,102 | A | * | 10/1997 | Lin | 446/46 |
| 5,720,651 | A | * | 2/1998 | Chien | 451/95 |
| D401,288 | S | | 11/1998 | Dunipace | |
| 5,873,761 | A | * | 2/1999 | Johnson | 446/47 |
| 6,168,115 | B1 | * | 1/2001 | Abdelkhaleq | 244/155 R |
| D471,507 | S | * | 3/2003 | Brunner | D12/325 |
| 6,544,093 | B2 | * | 4/2003 | Komuro | 446/47 |
| 6,626,009 | B1 | * | 9/2003 | Ohlund | 63/3.1 |
| 6,726,521 | B2 | * | 4/2004 | Peterson | 446/46 |
| 2004/0043694 | A1 | * | 3/2004 | Cohen et al. | 446/47 |

* cited by examiner

*Primary Examiner*—Derris H. Banks
*Assistant Examiner*—Urszula M Cegielnik

(57) ABSTRACT

A disc toy for throwing between at least two persons includes a disc with a panel and a flange. The panel has a top surface, a bottom surface and a peripheral edge having a substantially circular shape. A flange is integrally attached to and extends downwardly from the peripheral edge. A plurality of windows is positioned in the disc for allowing light to pass through the disc. Each of the windows is positioned at a juncture of the panel and the flange and the peripheral edge. A plurality of light emitters is provided. Each of a plurality of clip members is attached to the disc at a juncture of the bottom surface and the flange. Each of the clip members abuts one of the windows and each is adapted for releasably securing one of the light emitters in a position adjacent to one of the windows.

6 Claims, 4 Drawing Sheets

DISC TOY

BACKGROUND OF THE INVENTION

1. Field of the Invention

The present invention relates to throwing disc devices and more particularly pertains to a new throwing disc device which may be illuminated with detachable light emitters for tossing the disc in low light conditions.

2. Description of the Prior Art

The use of throwing disc devices is known in the prior art. Some of these devices, such as U.S. Pat. No. 4,086,723 describes a flying saucer toy which may have an illumination device attached thereto. While these devices fulfill their respective, particular objectives and requirements, the need remains for a flying saucer toy which includes windows therein for the enhanced viewing of light emitters attached thereto. It is also preferred that the flying saucer holds a plurality of light emitters which are spaced from each other such that better night time depth perception of the device is obtained.

SUMMARY OF THE INVENTION

The present invention meets the needs presented above by generally comprising a disc including a panel and a flange. The panel has a top surface, a bottom surface and a peripheral edge having a substantially circular shape. A flange is integrally attached to and extends downwardly from the peripheral edge. A plurality of windows is positioned in the disc for allowing light to pass through the disc. Each of the windows is positioned at a juncture of the panel and the flange and the peripheral edge. A plurality of light emitters is provided. Each of a plurality of clip members is attached to the disc at a juncture of the bottom surface and the flange. Each of the clip members abuts one of the windows and each is adapted for releasably securing one of the light emitters in a position adjacent to one of the windows.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
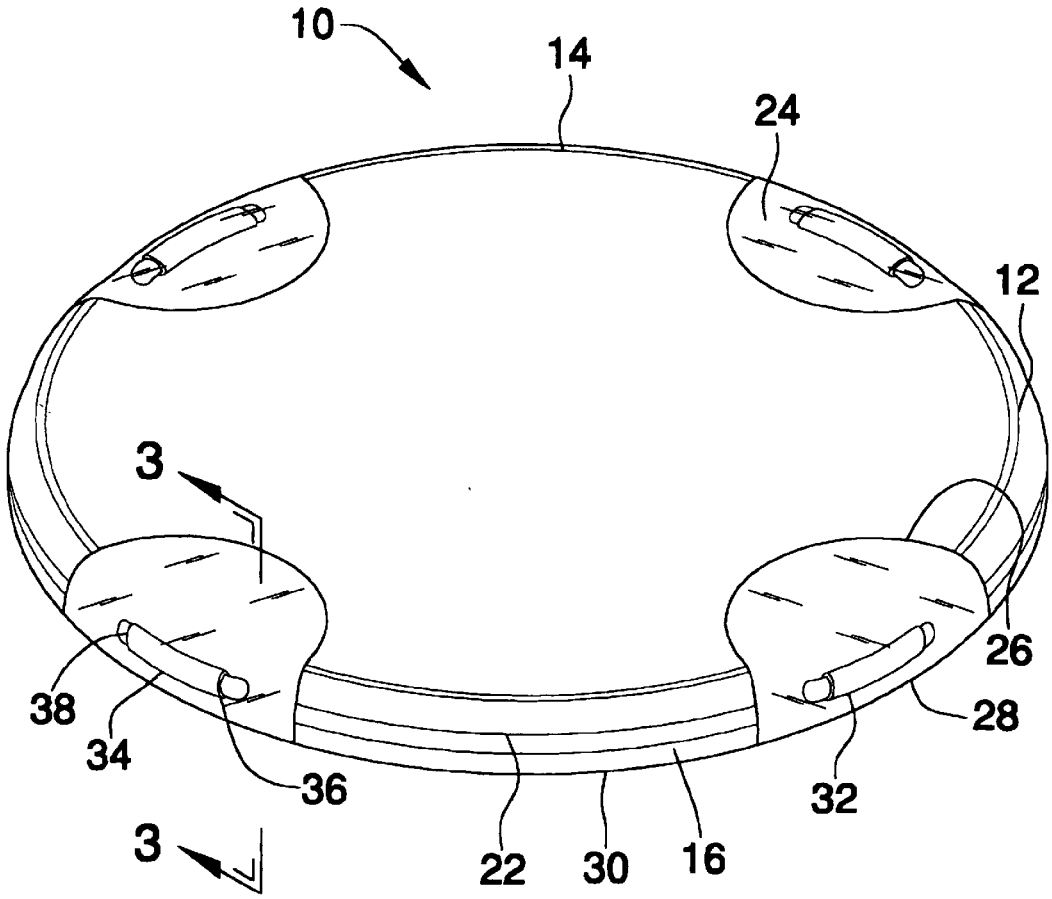
FIG. 1 is a schematic perspective view of a disc toy according to the present invention.

With reference now to the drawings, and in particular to FIG. 1 through 6 thereof, a new throwing disc device embodying the principles and concepts of the present invention and generally designated by the reference numeral 10 will be described.

As best illustrated in FIGS. 1 through 6, the disc toy 10 generally comprises a disc 12 that includes a panel 14 and a flange 16. The panel 14 has a top surface 18, a bottom surface 20 and a peripheral edge 22. The peripheral edge 22 has a substantially circular shape. The bottom surface 20 is concave and the top surface 18 is convex. The convex and concave shapes should be subtle with a rise of less 1 inch per 4 inches of run. A flange 16 is integrally attached to and extends downwardly from the peripheral edge 22. The flange 16 is angled inwardly with respect to the bottom surface 20. The panel 14 and flange 16 each preferably comprise a plastic material.

Each of a plurality of windows 24 is positioned in the disc 12 for allowing light to pass through the disc 12. Each of the windows 24 is positioned at a juncture of the panel 14 and the flange 16 and the peripheral edge 22. The windows 24 are spaced from each other and ideally substantially equidistant from each other. The windows 24 each have an inward edge 26 extending toward a central portion of the panel 14 and a bottom edge 28 extending to a free edge 30 of the flange 16. Each of the inward edges 26 is preferably arcuate. The windows 24 each preferably comprise a plastic material that is transparent or translucent. The plurality of windows 24 includes at least three windows 24. The number of windows 24 may be dependent upon the size of the disc 12. Thus, a disc 12 having a diameter of less than 10 inches will preferably have only three windows 24, while a disc larger than 10 inches may have four or five windows 24. The windows 24 are contoured to follow the shape of the flange 16 and panel 14 such that the windows 24 form part of the panel 14 and flange 16.

A plurality of light emitters 32 is provided. Each of the light emitters 32 has a tubular shape and is resiliently flexible. The light emitters 32 are preferably containers having chambers therein. When bent, the chambers crack to mix the contents thereof such that a chemical reaction takes place and the mixed contents emit a visible light. Such chemi-luminescent devices are widely available from suppliers such as www.glowsticks-party-supplies.com.

Each of a plurality of clip members 34 is attached to the disc 12 at a juncture of the bottom surface 20 and the flange 16. Each of the clip members 34 abuts one of the windows 24. The clip members 34 are each adapted for releasably securing one of the light emitters 32 in a position adjacent to one of the windows 24. Each of the clip members 34 preferably comprises a substantially transparent tubular member comprised of a resiliently flexible material that has a first open end 36 and a second open end 38. An elongated slot 40 extends through the tubular member, or clip member 34, and through the first 36 and second 38 ends. The tubular members 34 are each attached to and extend along the juncture of the panel 14 and the flange 16 such that the slots 40 face away from the flange 16. The light emitters 32 may be extended through the slot 40 and into the tubular members 34.

Figure 2:
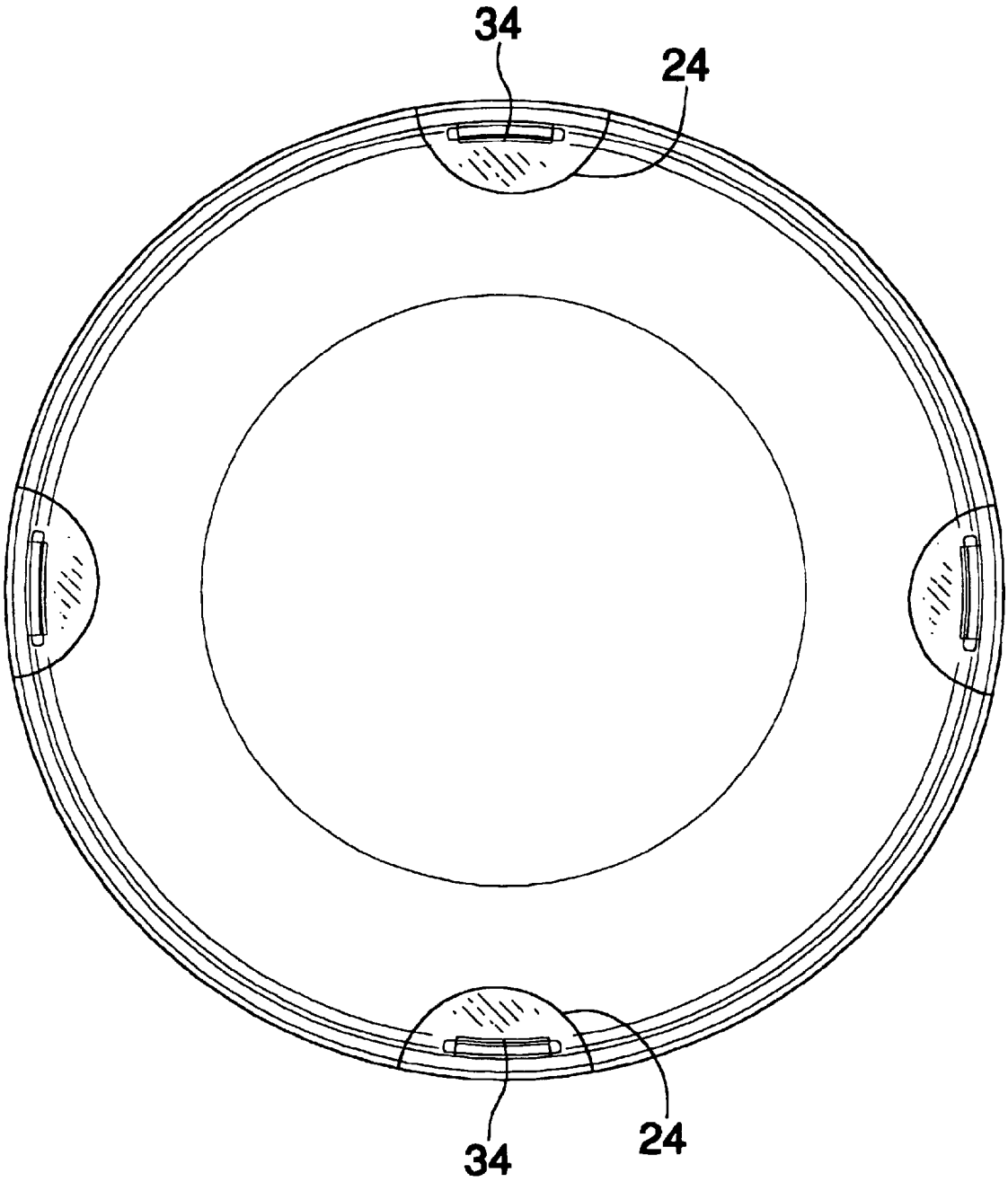
FIG. 2 is a schematic bottom view of the present invention.
Figure 3:
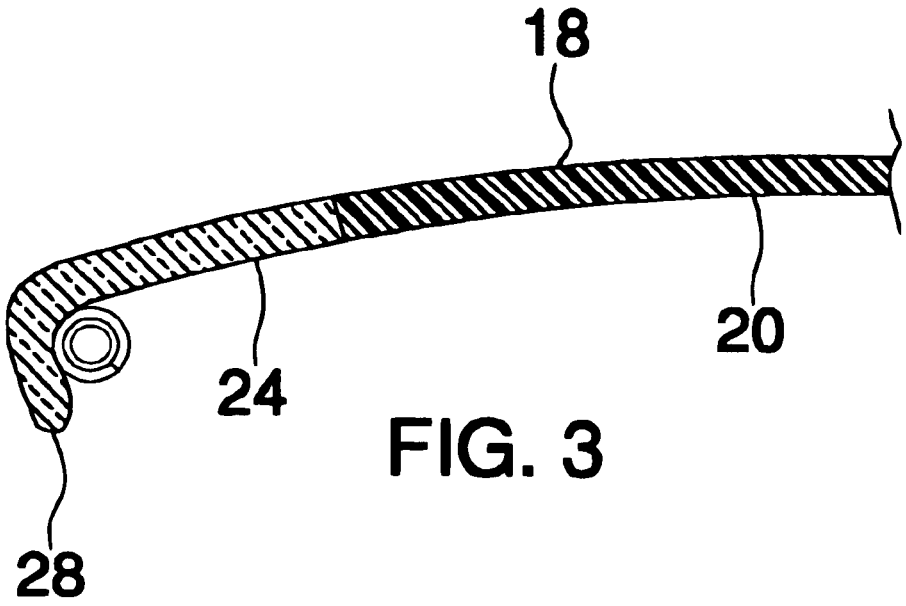
FIG. 3 is a schematic cross-sectional view of a window taken along line 3—3 of FIG. 1 of the present invention.
Figure 4:
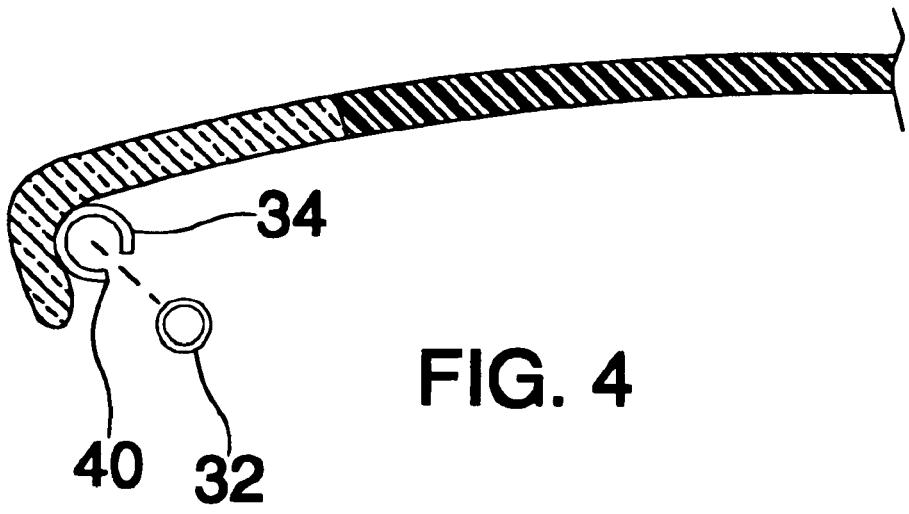
FIG. 4 is a schematic cross-sectional view of the window of the present invention.
Figure 5:
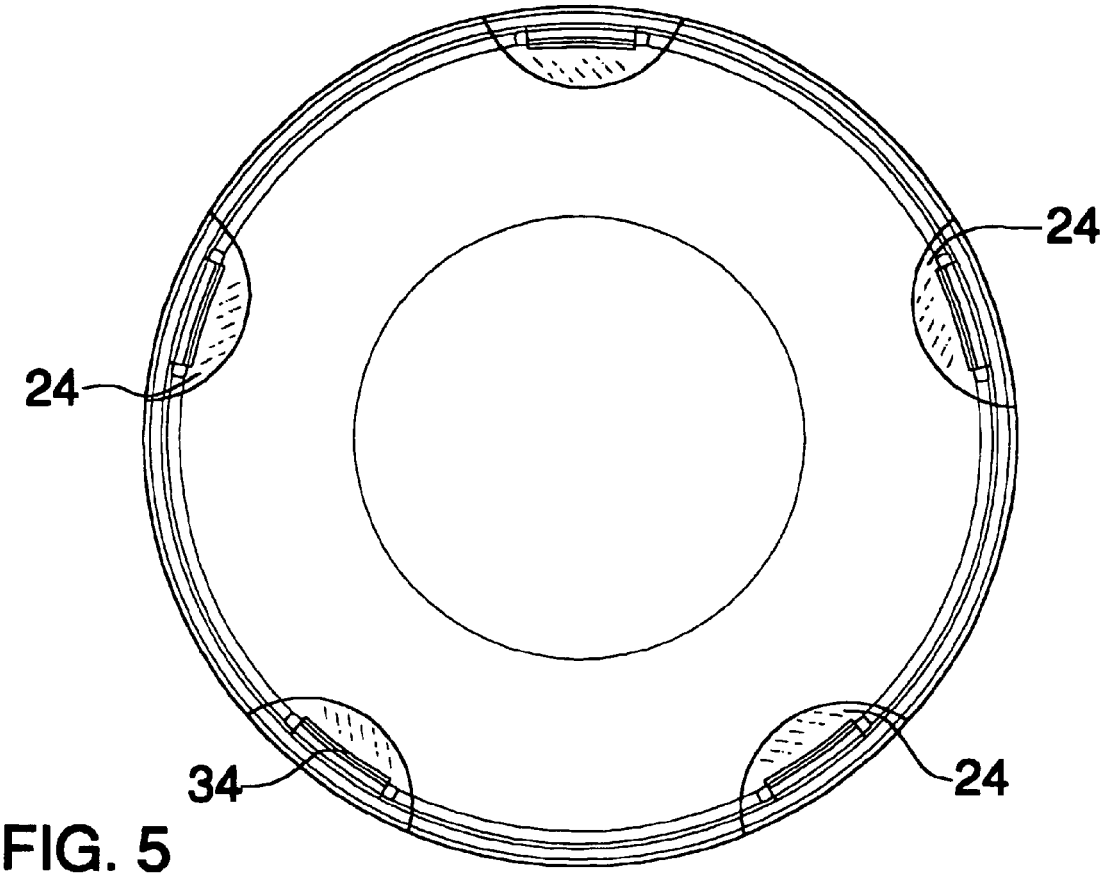
FIG. 5 is a schematic bottom view of a second embodiment of the present invention.
Figure 6:
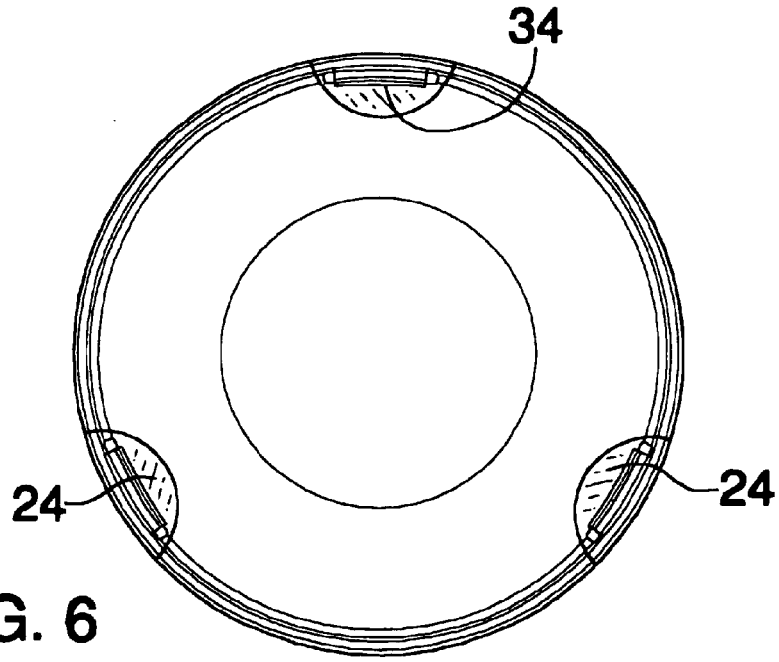
FIG. 6 is a schematic bottom view of a third embodiment of the present invention.

In use, the disc 12 is used a conventional throwing disc to be thrown between two or more persons. The light emitters 32 may be added, preferably when the ambient light is relatively low, to enhance the ability to see the disc 12. The light emitters 32 may be replaced as needed and allow the disc 12 to be used in daylight as well as during dark periods. FIGS. 2, 5 and 6 each depicts different variations of the toy 10 each having a different number of windows 24 therein. It is preferred that the toy 10 have five or less windows 24 therein.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A throwing disc toy comprising:

a disc including;

a panel having a top surface, a bottom surface and a peripheral edge, said peripheral edge having a substantially circular shape;

a flange being integrally attached to and extending downwardly from said peripheral edge;

a plurality of windows being positioned in said disc for allowing light to pass through said disc, each of said windows being positioned at a juncture of said panel and said flange and said peripheral edge;

a plurality of light emitters, each of said light emitters having a tubular shape and each being resiliently flexible; and a plurality of clip members, each of said clip members being attached to said disc at a juncture of said bottom surface and said flange, each of said clip members abutting one of said windows, each of said clip members being adapted for releasably securing one of said light emitters in a position adjacent to one of said windows, each of said clip members comprising a substantially transparent tubular member comprised of a resiliently flexible material and having a first open end and a second open end, an elongated slot extending through said tubular member and through said first and second open ends, each of said tubular members being attached to and extending along said juncture of said panel and said flange such that said slots face away from said flange, wherein said light emitters may be extended through said slot and into said tubular members.

2. The disc according to claim 1, wherein said windows are spaced generally an equal distance from each other.

3. The disc according to claim 1, wherein each of said windows has an inward edge extending toward a central portion of said panel and a bottom edge extending to a free edge of said flange, each of said inward edges being arcuate.

4. The disc according to claim 1, wherein said plurality of windows includes at least three windows.

5. The disc according to claim 1, wherein said plurality of windows includes at least five windows.

6. A throwing disc toy comprising:

a disc including;

a panel having a top surface, a bottom surface and a peripheral edge, said peripheral edge having a substantially circular shape, said bottom surface being concave and said top surface being convex;

a flange being integrally attached to and extending downwardly from said peripheral edge, said flange being angled inwardly with respect to said bottom surface, said panel and flange each comprising a plastic material;

a plurality of windows being positioned in said disc for allowing light to pass through said disc, each of said windows being positioned at a juncture of said panel and said flange and said peripheral edge, said windows being spaced from each other, each of said windows having an inward edge extending toward a central portion of said panel and a bottom edge extending to a free edge of said flange, each of said inward edges being arcuate, each of said windows comprising a plastic material, said plurality of windows including at least three windows;

a plurality of light emitters, each of said light emitters having a tubular shape and being resiliently flexible; and a plurality of clip members, each of said clip members being attached to said disc at a juncture of said bottom surface and said flange, each of said clip members abutting one of said windows, each of said clip members being adapted for releasably securing one of said light emitters in a position adjacent to one of said windows, each of said clip members comprising a substantially transparent tubular member comprised of a resiliently flexible material and having a first open end and a second open end, an elongated slot extending through said tubular member and through said first and second ends, each of said tubular members being attached to and extending along said juncture of said panel and said flange such that said slots face away from said flange, wherein said light emitters may be extended through said slot and into said tubular members.

* * * * *